US010513920B2

(12) United States Patent
Salminen et al.

(10) Patent No.: US 10,513,920 B2
(45) Date of Patent: Dec. 24, 2019

(54) REAL-TIME STUCK PIPE WARNING SYSTEM FOR DOWNHOLE OPERATIONS

(71) Applicant: Weatherford Technology Holdings, LLC, Houston, TX (US)

(72) Inventors: Kent Patrick Salminen, Houston, TX (US); Curtis Alan Cheatham, The Woodlands, TX (US); Mark Adrian Smith, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 247 days.

(21) Appl. No.: 15/008,161

(22) Filed: Jan. 27, 2016

(65) Prior Publication Data

US 2016/0369621 A1 Dec. 22, 2016

Related U.S. Application Data

(60) Provisional application No. 62/181,982, filed on Jun. 19, 2015.

(51) Int. Cl.
*E21B 47/12* (2012.01)
*E21B 44/00* (2006.01)
(Continued)

(52) U.S. Cl.
CPC ..... *E21B 47/12* (2013.01); *E21B 7/00* (2013.01); *E21B 7/28* (2013.01); *E21B 19/00* (2013.01); *E21B 44/00* (2013.01)

(58) Field of Classification Search
CPC ... E21B 47/12; E21B 7/00; E21B 7/28; E21B 19/00; E21B 44/00
See application file for complete search history.

(56) References Cited

U.S. PATENT DOCUMENTS 4,791,998 A 12/1988 Hempkins et al.
5,181,172 A 1/1993 Whitten
(Continued)

FOREIGN PATENT DOCUMENTS

WO 03089758 A1 10/2003
WO 2013066746 A1 5/2013
(Continued)

OTHER PUBLICATIONS

PCT International Search Report and Written Opinion dated Sep. 21, 2016, for International Application No. PCT/US2016/037842.
(Continued)

*Primary Examiner* — Cuong B Nguyen
(74) *Attorney, Agent, or Firm* — Patterson + Sheridan, LLP

(57) ABSTRACT

A method of performing an operation in a wellbore includes performing the operation in the wellbore from a rig; and, while performing the operation, repeatedly: inputting one or more predicted values from a model of the wellbore; inputting one or more measured parameters from one or more sensors of the rig; calculating a deviation of each measured parameter from a respective predicted value; applying a weighting factor to each calculated deviation to obtain a respective alert level; calculating a rate of change of each measured parameter from a parameter previously measured by the respective sensor; applying a weighting factor to each calculated rate of change to obtain a respective alert level; and adding the alert levels and dividing the sum thereof by a maximum alert level to obtain a stuck pipe risk.

21 Claims, 12 Drawing Sheets

(51) Int. Cl.

| | |
|---|---|
| ***E21B 7/00*** | (2006.01) |
| ***E21B 7/28*** | (2006.01) |
| ***E21B 19/00*** | (2006.01) |

(56) References Cited

U.S. PATENT DOCUMENTS

| | | | | |
|---|---|---|---|---|
| 5,454,436 | A | 10/1995 | Jardine et al. | |
| 6,401,838 | B1 | 6/2002 | Rezmer-Cooper | |
| 8,752,648 | B2 | 6/2014 | Goebel et al. | |
| 2004/0204813 | A1* | 10/2004 | Doering | F02D 41/1401 701/110 |
| 2007/0199721 | A1* | 8/2007 | Givens | G06Q 10/06 166/382 |
| 2014/0077963 | A1 | 3/2014 | Dankers et al. | |
| 2014/0122047 | A1 | 5/2014 | Saldivar et al. | |
| 2014/0209383 | A1 | 7/2014 | Vuyk, Jr. | |
| 2014/0351183 | A1 | 11/2014 | Germain et al. | |
| 2015/0134257 | A1 | 5/2015 | Erge et al. | |
| 2015/0167466 | A1 | 6/2015 | Teodorescu et al. | |
| 2015/0354603 | A1 | 12/2015 | Nishikawa et al. | |
| 2015/0356403 | A1 | 12/2015 | Storm, Jr. | |

FOREIGN PATENT DOCUMENTS

| | | | |
|---|---|---|---|
| WO | 2013185005 | A2 | 12/2013 |
| WO | 2014/133501 | A1 | 9/2014 |
| WO | 2015060865 | A1 | 4/2015 |

OTHER PUBLICATIONS

Weatherford Rip Tide Drilling Reamer catalog, 2004-2012, 12 pages.

Weatherford Revolution Slide Reduction Tool brochure, 2014, 2 pages.

Weatherford Revolution Rotary-Steerable System brochure, 2007-2009, 16 pages.

Weatherford Revolution Rotary-Steerable Service, Directional Drilling, 2006-2008, 2 pages.

Kent Salminen et al., Stuck Pipe Prediction Using Automated Real-Time Modeling and Data Analysis, IADC/SPE-178888-MS, Society of Petroleum Engineers, Mar. 2016, 22 pages.

International Preliminary Report on Patentability in related application PCT/US2016/037842 dated Dec. 28, 2017.

* cited by examiner

| Activity | Allowable Hook Load (HL) Deviation | Allowable Torque (TQ) Deviation | Allowable Standpipe Pressure (SPP) Deviation |
|---|---|---|---|
| Rotary Drill | -2% to -25% | 2% to 25% | 2% to 25% |
| Slide Drill | -2% to -25% | N/A | 2% to 25% |
| Ream In | -2% to -25% | 2% to 25% | 2% to 25% |
| Back Ream | 2% to 25% | 2% to 25% | 2% to 25% |
| Trip In | -2% to -25% | N/A | N/A |
| Trip Out | 2% to 25% | N/A | N/A |

FIG. 3A

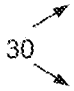

| Activity | Allowable HL Rate of Change | Allowable TQ Rate of Change | Allowable SPP Rate of Change |
|---|---|---|---|
| Rotary Drill | -2% to -25% | 2% to 25% | 2% to 25% |
| Slide Drill | -2% to -25% | N/A | 2% to 25% |
| Ream In | -2% to -25% | 2% to 25% | 2% to 25% |
| Back Ream | 2% to 25% | 2% to 25% | 2% to 25% |
| Trip In | -2% to -25% | N/A | N/A |
| Trip Out | 2% to 25% | N/A | N/A |

FIG. 3B

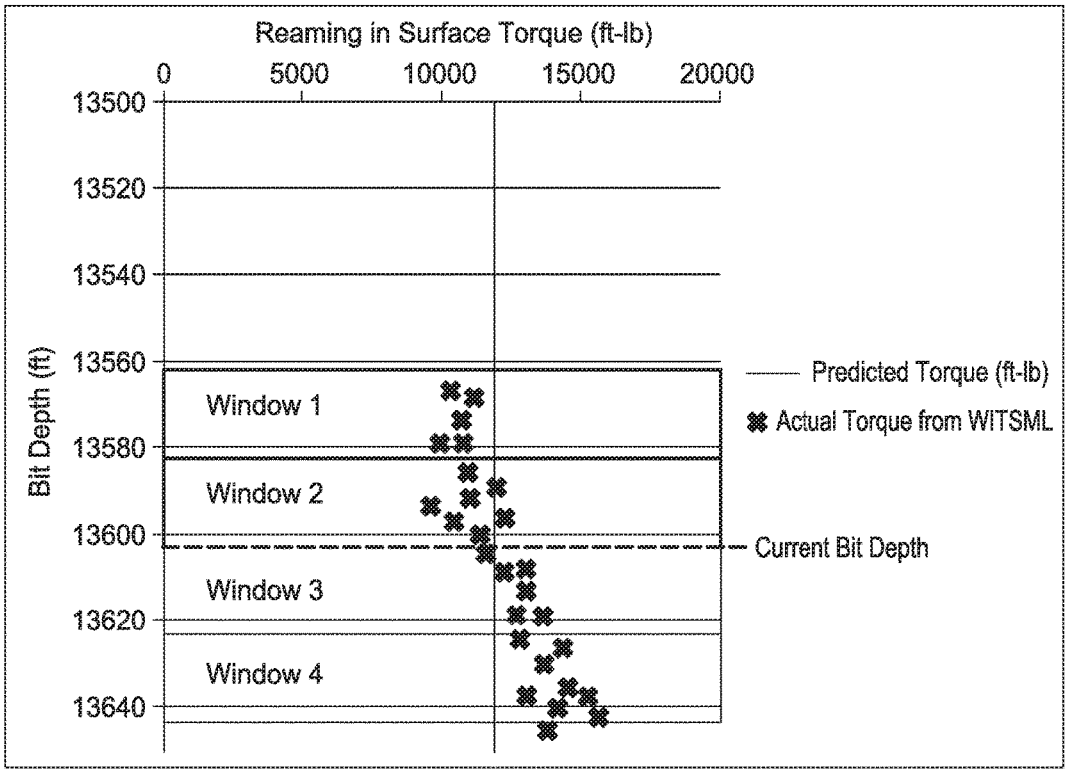

FIG. 4A

31

| Rig Activity | Maximum Allowable Deviation | Rate of Change |
|---|---|---|
| Slide Drill | [Deviation_Window 2] | [MVG AVG_Window 2] - [MVG AVG_Window 1] / [MVG AVG_Window 1] |
| Rotary Drill | [Deviation_Window 2] | [MVG AVG_Window 2] - [MVG AVG_Window 1] / [MVG AVG_Window 1] |
| Ream In | [Deviation_Window 2] | [MVG AVG_Window 2] - [MVG AVG_Window 1] / [MVG AVG_Window 1] |
| Back Ream | [Deviation_Window 3] | [MVG AVG_Window 4] - [MVG AVG_Window 3] / [MVG AVG_Window 3] |
| Trip In | [Deviation_Window 2] | [MVG AVG_Window 2] - [MVG AVG_Window 1] / [MVG AVG_Window 1] |
| Trip Out | [Deviation_Window 3] | [MVG AVG_Window 4] - [MVG AVG_Window 3] / [MVG AVG_Window 3] |

FIG. 4B 32, 33

$$x_{predicted} = x_1 + \left(\frac{x_2 - x_1}{z_2 - z_1}\right) z_{actual}$$

$$where\ z_1 < z_{actual} < z_2$$

34

$$Deviation = \left( \frac{x_{actual} - x_{predicted}}{x_{predicted}} \right) x\,100$$

FIG. 6A

36

| (Calculated Deviation) / (Allowable) | Less than 1 | Between 1 and 3 | Greater than 3 |
|---|---|---|---|
| Alert Level | 0 | (Calculated Deviation) / (Allowable) | 3 |

FIG. 6B 37, 38

$$ROC = \frac{MVG\ \ AVG_{Window\ 2} - MVG\ \ AVG_{Window\ 1}}{MVG\ \ AVG_{Window\ 1}}\ x\,100$$

FIG. 6C

39

| (Calculated ROC) / (Allowable) | Less than 1 | Between 1 and 3 | Greater than 3 |
|---|---|---|---|
| Alert Level | 0 | (Calculated ROC) / (Allowable) | 3 |

FIG. 6D

40

$$Stuck\ \ Pipe\ \ Risk = \frac{Sum\ \ of\ \ all\ \ Alert\ \ Levels}{Maximum\ \ Alert\ \ Level}\ x\,100$$

FIG. 6E

REAL-TIME STUCK PIPE WARNING SYSTEM FOR DOWNHOLE OPERATIONS

BACKGROUND OF THE DISCLOSURE

Field of the Disclosure

The present disclosure generally relates to a real-time stuck pipe warning system for downhole operations.

Description of the Related Art

A wellbore is formed to access hydrocarbon-bearing formations (e.g., crude oil and/or natural gas) or for geothermal power generation by the use of drilling. Drilling is accomplished by utilizing a drill bit that is mounted on the end of a drill string. To drill within the wellbore to a predetermined depth, the drill string is often rotated by a top drive on a drilling rig. After drilling to a predetermined depth, the drill string and drill bit are removed and a string of casing is lowered into the wellbore. An annulus is thus formed between the casing string and the wellbore. The casing string is hung from the wellhead. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Stuck pipe during drilling is a common and expensive problem. Operating companies lose valuable rig time due to stuck pipe and in the worst case can lose an entire wellbore section along with the bottom hole assembly (BHA) of the drill string. Service companies lose the value of the BHA while also suffering opportunity cost. Several companies have developed practices for preventing stuck pipe along with remedial actions in the event of stuck pipe. However, these practices are not standard across the industry and too often focus primarily on after-the-fact solutions. Stuck pipe is so prevalent that it is sometimes considered a normal operating risk. Stuck pipe may also be a problem for other downhole operations besides drilling.

SUMMARY OF THE DISCLOSURE

The present disclosure generally relates to a real-time stuck pipe warning system for downhole operations. In one embodiment, a method of performing an operation in a wellbore includes performing the operation in the wellbore from a rig; and, while performing the operation, repeatedly: inputting one or more predicted values from a model of the wellbore; inputting one or more measured parameters from one or more sensors of the rig; calculating a deviation of each measured parameter from a respective predicted value; applying a weighting factor to each calculated deviation to obtain a respective alert level; calculating a rate of change of each measured parameter from a parameter previously measured by the respective sensor; applying a weighting factor to each calculated rate of change to obtain a respective alert level; and adding the alert levels and dividing the sum thereof by a maximum alert level to obtain a stuck pipe risk.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIGS. 3A and 3B illustrate allowable deviations and rates of change obtained from historical data for use in operation of the stuck pipe warning system.

FIGS. 4A and 4B illustrate sample windows and selection thereof for various rig activities by the stuck pipe warning system.

FIG. 6A illustrates calculation of a deviation of a measured parameter by the stuck pipe warning system. FIG. 6B illustrates application of a weighting factor to the calculated deviation to obtain an alert level by the stuck pipe warning system.

FIG. 6C illustrates calculation of a rate of change of an average of a measured parameter by the stuck pipe warning system. FIG. 6D illustrates application of a weighting factor to the calculated rate of change to obtain an alert level by the stuck pipe warning system. FIG. 6E illustrates calculation of a stuck pipe risk by the stuck pipe warning system.

DETAILED DESCRIPTION

Figure 1:
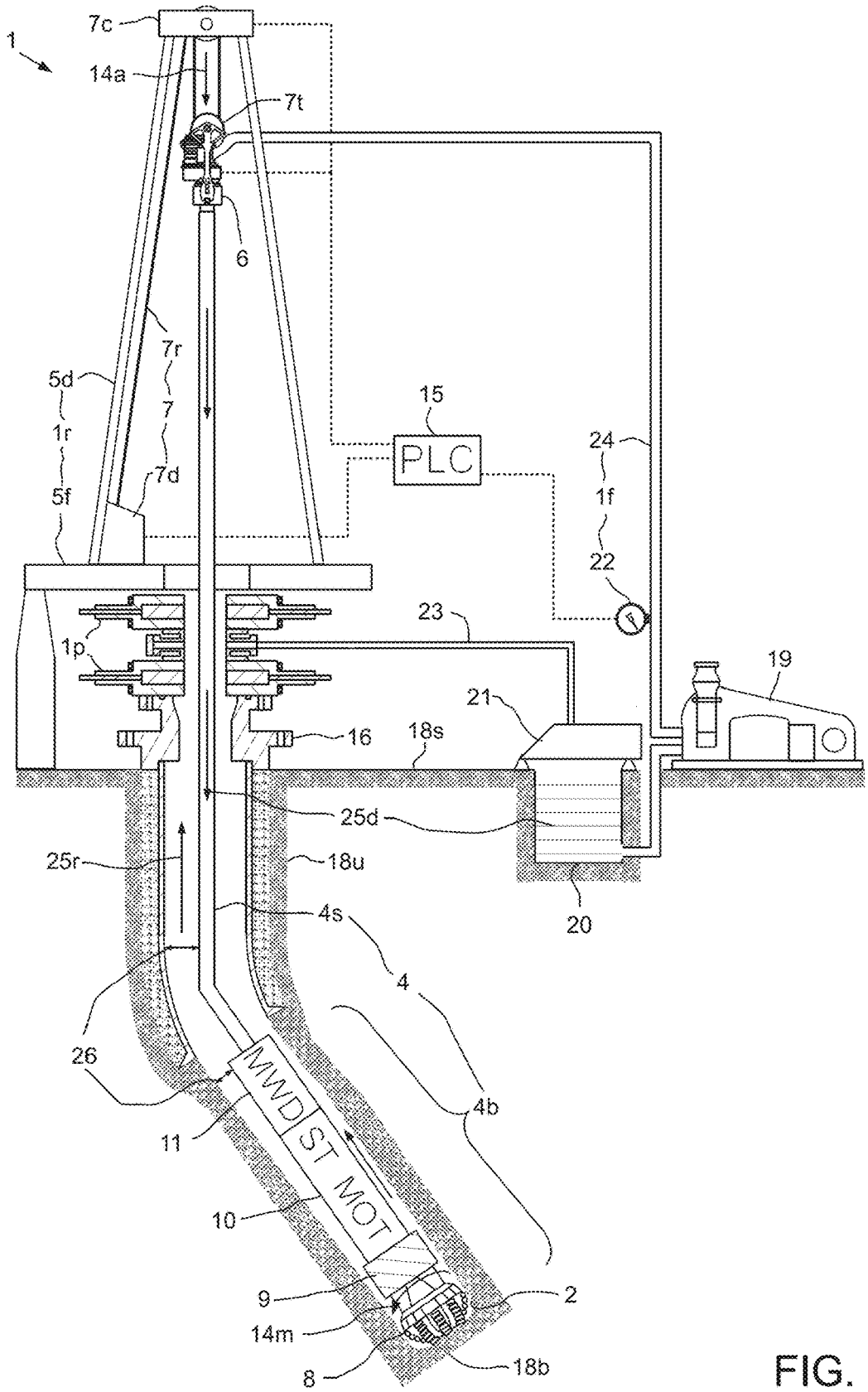
FIG. 1 illustrates slide drilling of a wellbore using a drilling system having a stuck pipe warning system, according to one embodiment of the present disclosure.

FIG. 1 illustrates slide drilling of a wellbore 2 using a drilling system 1 having a stuck pipe warning system 3 (FIG. 2), according to one embodiment of the present disclosure. The drilling system 1 may further include a drilling rig 1*r*, a fluid handling system 1*f*, a pressure control assembly 1*p*, a drill string 4, and a rig controller, such as a programmable logic controller (PLC) 15. The stuck pipe warning system 3 may include operating steps 31-42 (FIG. 2), operating steps 61-72 (FIG. 12) loaded onto the PLC 15 for execution thereby during slide drilling. The drilling rig 1*r* may include a derrick 5*d*, a floor 5*f*, a top drive 6, and a hoist 7. The rig floor 5*f* may have an opening through which the drill string 4 extends downwardly into the PCA 1*p*.

Alternatively, the operating steps 31-42, 61-72 may be loaded onto an auxiliary computer in data communication with the PLC 15, such as a desktop, server, laptop, netbook, tablet, or smart phone.

The drill string 4 may include a bottomhole assembly (BHA) 4*b* and a pipe string 4*s*. The pipe string 4*s* may include joints of drill pipe connected together, such as by threaded couplings. The BHA 4*b* may be connected to the pipe string 4*s*, such as by threaded couplings. The BHA 4*b* may include a drill bit 8, a stabilizer 9, a steerable drilling motor (ST MOT) 10, and a measurement while drilling (MWD) tool 11. The BHA members 8-11 may be interconnected, such as by threaded couplings. The drill bit 8 may be rotated 14*m* by the steerable drilling motor 10. The steerable drilling motor 10 may be a mud motor, such as a progressive cavity motor, operated by harnessing mechanical energy from hydraulic energy of drilling fluid 25*d* pumped through the BHA 4*b*. The steerable drilling motor 10 may have a deviated (aka bent) output shaft for directional drilling.

Alternatively, the drill string 4 may include coiled tubing and an orienter instead of the pipe string 4*s*.

The MWD tool 11 may include a mandrel having threaded couplings formed at each longitudinal end thereof, an electronics package mounted on the mandrel, a sensor package mounted on the mandrel, a housing connected to the mandrel to protect the packages, and a battery disposed between the housing and the mandrel. The electronics package may include a microcontroller, a clock, and an analog to digital converter. The electronics package and sensor package may be in electrical communication by leads, a bus, or integration on a printed circuit board. The sensor package may include an inclination sensor and an azimuth sensor. The MWD electronics package may further include a modem in electrical communication with an uplink (not shown) for operation thereof to send measurements by the sensor package to the PLC 15. The uplink may be a mud pulser or a gap sub for sending the measurements via electromagnetic telemetry.

An upper end of the pipe string 4*s* may be connected to a quill of the top drive 6, such as by threaded couplings. The top drive 6 may include a motor for rotating 14*t* (FIG. 8) the drill string 4. The top drive motor may be electric or hydraulic. A frame of the top drive 4 may be coupled to a rail (not shown) of the derrick 5*d* for preventing rotation thereof during rotation 14*t* of the drill string 4 and allowing for vertical movement of the top drive with a traveling block 7*t* of the rig hoist 7. The frame of the top drive 6 may be suspended from the derrick 5*d* by the traveling block 7*t*. The traveling block 7*t* may be supported by wire rope 7*r* connected at its upper end to a crown block 7*c* of the rig hoist 7. The wire rope 7*r* may be woven through sheaves of the blocks 7*c,t* and extend to drawworks 7*d* of the hoist 7 for reeling thereof, thereby raising or lowering the traveling block 7*t* relative to the derrick 5*d*.

The PCA 1*p* may include one or more blow out preventers (BOPs) and a flow cross. A housing of each BOP and the flow cross may each be interconnected and/or connected to a wellhead 16, such as by a flanged connection. The wellhead 16 may be mounted on a casing string 17 which has been deployed into the wellbore 2 drilled from a surface 18*s* of the earth and cemented into the wellbore. The casing string 17 may extend to a depth adjacent a bottom of an upper formation 18*u*. The upper formation 18*u* may be non-productive and a lower formation 18*b* may be a hydrocarbon-bearing reservoir.

Alternatively, the lower formation 18*b* may be non-productive (e.g., a depleted zone), environmentally sensitive, such as an aquifer, or unstable. Alternatively, the wellbore 2 may be subsea having a wellhead located adjacent to the waterline and the drilling rig 1*r* may be a located on a platform adjacent the wellhead. Alternatively, the wellbore 2 may be subsea having a wellhead located adjacent to the seafloor and the drilling rig 1*r* may be a located on an offshore drilling unit.

The fluid system 1*f* may include a mud pump 19, a drilling fluid reservoir, such as a pit 20 or tank, a solids separator, such as a shale shaker 21, a pressure sensor 22, one or more flow lines, such as a return line 23, a supply line 24, and a feed line. A first end of the return line 23 may be connected to the flow cross of the PCA 1*p* and a second end of the return line may be connected to an inlet of the shaker 21. A lower end of the supply line 24 may be connected to an outlet of the mud pump 19 and an upper end of the supply line may be connected to an inlet of the top drive 6. The pressure sensor 22 may be assembled as part of the supply line 24.

The pressure sensor 22 may be in data communication with the PLC 15 and may be operable to monitor standpipe pressure (SPP). The PLC 15 may also be in communication with a hook load detector (depicted by dotted line to crown block 7*c*) clamped to the wire rope 7*r*, and a position sensor of the drawworks 7*d* for monitoring depth of the drill bit 8. The PLC 15 may further be in communication with a torque sensor of the top drive 6 (depicted by dotted line to the top drive).

To extend the wellbore 2 from the casing shoe into the lower formation 18*b*, the mud pump 19 may pump the drilling fluid 25*d* from the pit 20, through the supply line 24, and to the top drive 6. The drilling fluid 25*d* may include a base liquid. The base liquid may be refined and/or synthetic oil, water, brine, or a water/oil emulsion. The drilling fluid 25*d* may further include solids dissolved or suspended in the base liquid, such as organophilic clay, lignite, and/or asphalt, thereby forming a mud.

The drilling fluid 25*d* may flow from the supply line 24 and into a bore of the pipe string 4*s* via the top drive 6. The drilling fluid 25*d* may flow down the pipe string 4*s*, through a bore of the BHA 4*b*, and exit the drill bit 8, where the fluid may circulate cuttings away from the bit and return the cuttings up an annulus 26 formed between an inner surface of the casing string 24 or wellbore 2 and an outer surface of the drill string 4. The returns 25*r* (drilling fluid 25*d* plus cuttings) may flow up the annulus 26, to the wellhead 16, and exit the wellhead through the flow cross of the PCA 1*p*. The returns 25*r* may continue through the return line 23. The returns 25*r* may then flow into the shale shaker 21 and be processed thereby to remove the cuttings, thereby completing a cycle. As the drilling fluid 25*d* and returns 25*r* circulate, the drill bit 8 may be rotated 14*m* by the drilling motor 10 and lowered 14*a* by the traveling block 7*c*, thereby extending the wellbore 2 into the lower formation 18*b*. The pipe string 4*s* may be held rotationally stationary by the top drive 6 and inclination of the drill bit 8 by the motor 10 may cause drilling along a curved trajectory.

Figure 2:
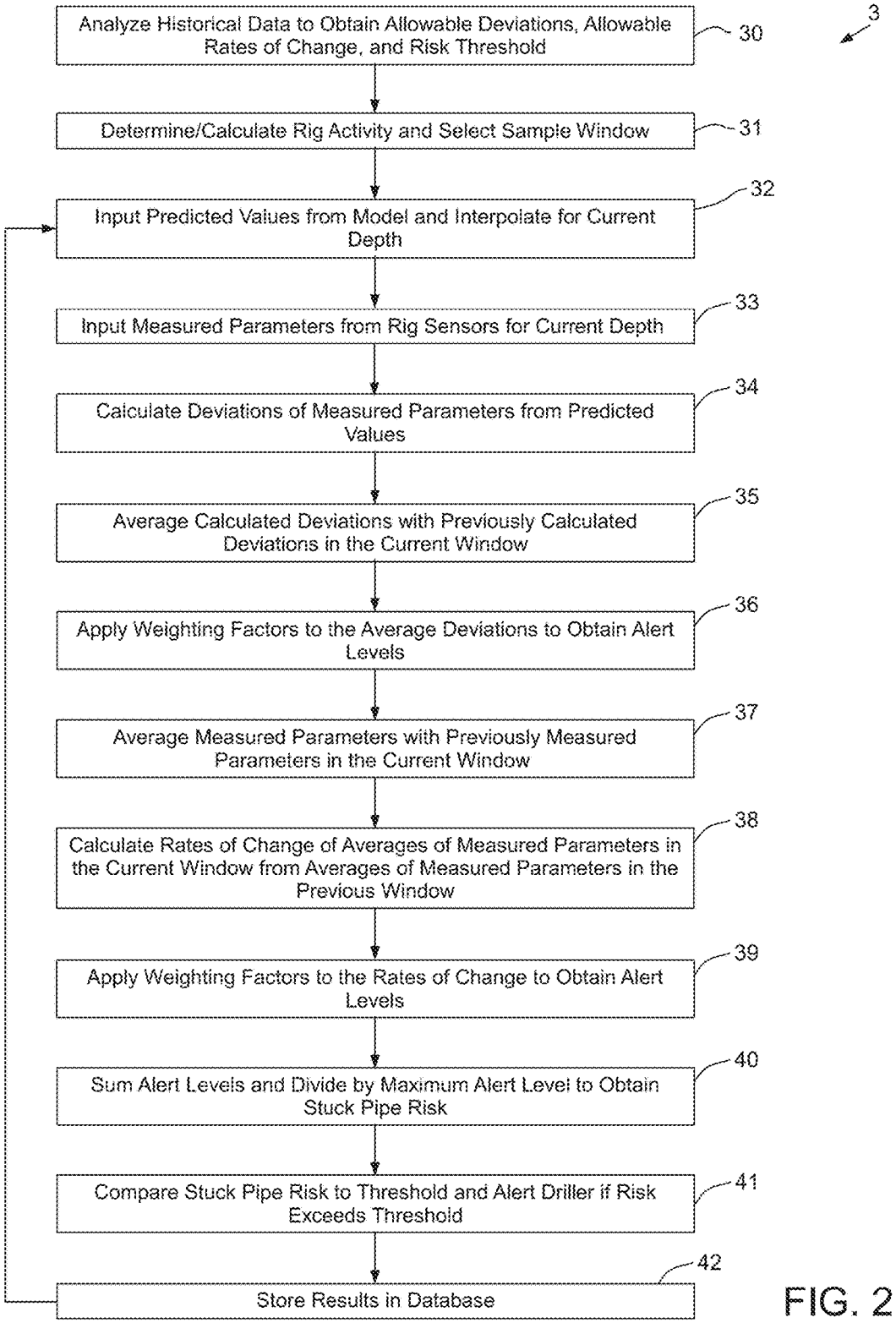
FIG. 2 illustrates one method of operation of the stuck pipe warning system.

FIG. 2 illustrates one method of operation of the stuck pipe warning system 3. Referring also to FIGS. 3A and 3B, at step 30, the stuck pipe warning system 3 may be manually initialized by analyzing historical data from similar wellbores drilled in the same or similar oilfields. The previously drilled wellbores may be selected based on having had stuck pipe incidents and the historical data may be analyzed to determine the root cause of each. Specific patterns in the historical data may be identified as leading indicators of stuck pipe. The leading indicators may include one or more parameters, such as torque, standpipe pressure, and hook load. The historical analysis may include reviewing deviations in the parameters from expected values determined by a model of the previously drilled wellbores.

From this analysis, allowable deviations of the parameters from the expected values may be determined. If the deviation is positive, it may be characterized as a maximum allowable deviation and if the deviation is negative, it may be characterized as a minimum allowable deviation. The historical data may also be analyzed to determine allowable rates of change of the parameters with respect to depth. The allowable deviations and rates of change may be determined for specific rig activities, such as rotary drilling, slide drilling, forward reaming (aka ream in), backward reaming, tripping of the drill string 4 into the wellbore 2, and tripping the drill string from the wellbore. Only some of the parameters may be applicable for certain rig activities.

The allowable deviations and rates of change may be selected from ranges varying between positive two and twenty-five percent and negative two and twenty-five percent depending on the parameter or rate of change of the parameter and the activity being performed. Specific values of the allowable deviations and rates of change may be selected based upon parameters of the lower formation 18*b*, wellbore geometry, and parameters of the BHA 4*b*.

The historical analysis may further include assessing a stuck pipe risk threshold based on a cost-benefit analysis of the historical data and the type of well being drilled. For example, a higher threshold may be tolerated for a terrestrial wellbore as compared to a lower threshold for an offshore wellbore where the costs of stuck pipe may be far greater. The stuck pipe risk threshold may range between ten and fifty percent.

Alternatively, the historical analysis may be performed by a machine learning process, such as a neural network.

Once the allowable deviations and rates of change have been determined from the analysis of historical data, the allowable values may be provided to the PLC 15 for execution of operating steps 31-42.

Referring also to FIGS. 4A and 4B, at step 31, the PLC 15 may determine the rig activity that is about to be performed from configuration of the BHA 4*b*, whether the top drive 6 is being operated to rotate the drill string 4 or hold the drill string rotationally stationary, and/or whether the mud pump 19 is being operated to pump drilling fluid through the drill string. Once the PLC 15 has determined the activity, the PLC may form and select the location of sample windows for averaging the deviations and rates of changes. Averaging the deviations and rates of change may desensitize the stuck pipe warning system 3 to anomalies in the measured values and/or errors in the model.

As shown, each window has been sized at twenty-five feet (seven point six meters); however, the window size may be adjusted by the driller between a range of ten to fifty feet (three to fifteen point two meters). The location of the windows may be determined based on the activity to be performed. For forward activities, the windows may be above the current bit depth and for backward activities, the windows may be below the current bit depth. Once the activity has begun, the PLC 15 may refrain from steps 34-41 until enough measured parameters have been collected to fill the windows. As the operating steps 31-42 are iterated by the PLC 15 during the activity, the PLC may move the sample windows with progression of the current depth.

Alternatively, the PLC 15 may prompt the driller to select the activity that is about to be performed.

Figures 5A, 5B:
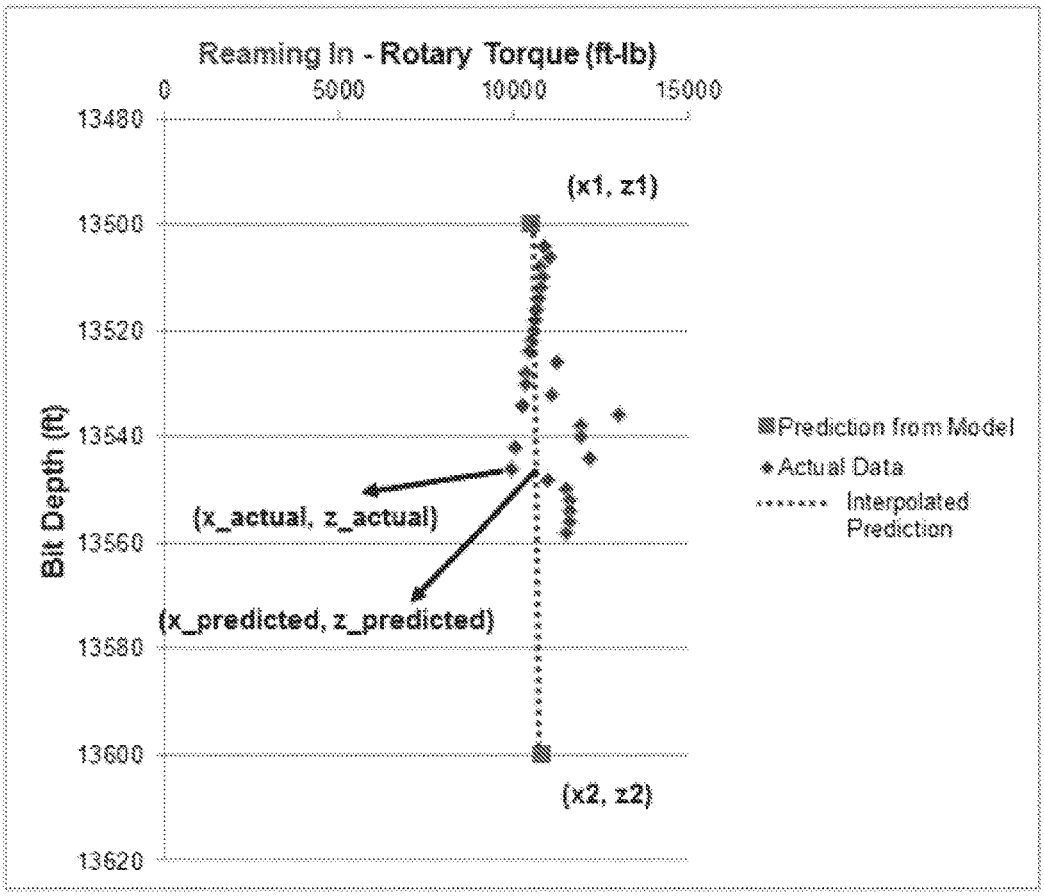
FIGS. 5A and 5B illustrate interpolation of predicted values from a model by the stuck pipe warning system.

Referring also to FIGS. 5A and 5B, at step 32, the PLC 15 may input the predicted values from the model. The model may only generate predicted values at a relatively low frequency, such as once per one hundred feet (thirty point five meters). The PLC 15 may operate the operating steps at a much higher frequency, such as between one iteration every five feet (one point five meters) and one iteration every one inch (twenty-five millimeters). The PLC 15 may utilize sets of two predicted values at depths straddling the current depth for each parameter to interpolate a predicted value for the current depth.

At step 33, the PLC 15 may input the measured parameters from the rig sensors, such as torque from the sensor of the top drive 6, standpipe pressure from the pressure sensor 22, and hook load from the detector (depicted by dashed line to crown block 7*c*). Referring also to FIG. 6A, at step 34, the PLC 15 may calculate deviations of the measured parameters from the respective predicted values using the formula shown therein. At step 35, the PLC 15 may average the calculated deviations with previously calculated deviations in the current window.

Referring also to FIG. 6B, at step 36, the PLC 15 may apply weighting factors to the average deviations to obtain alert levels. To apply the weighting system, the PLC 15 may divide the average deviations by the respective allowable deviations to obtain deviation ratios. If each deviation ratio is less than one, the PLC 15 may assign the respective deviation a zero alert level. If each deviation ratio is greater than or equal to one and less than or equal to three, the PLC 15 may assign the respective deviation an alert level equal to the respective ratio. If each deviation ratio is greater than three, the PLC 15 may assign the respective deviation an alert level of three. This weighting system may give deviations that exceed the respective allowable deviation by a large margin greater weight than those that only slightly exceed the respective allowable deviation while further desensitizing the stuck pipe warning system 3 to anomalies in the measured values and/or errors in the model.

Referring also to FIG. 6C, at step 37, in preparation for calculating the rates of change (ROCs), the PLC 15 may average the measured parameters with respective previously measured parameters in the current window. Still referring also to FIG. 6C, at step 38, the PLC 15 may calculate rates of change of the average measured parameters in the current window from the respective average measured parameters in the previous window using the formula shown therein (see also FIG. 4B). The rates of change calculations may not utilize the predicted values from the model, thereby further desensitizing the stuck pipe warning system 3 from errors in the model.

Referring also to FIG. 6D, at step 39, the PLC 15 may apply weighting factors to the rates of change to obtain alert levels. To apply the weighting system, the PLC 15 may divide the rates of change by the respective allowable rates of change to obtain ROC ratios. If each ROC ratio is less than one, the PLC 15 may assign the respective rate of change a zero alert level. If each ROC ratio is greater than or equal to one and less than or equal to three, the PLC 15 may assign the respective rate of change an alert level equal to the respective ratio. If each ROC ratio is greater than three, the PLC 15 may assign the respective rate of change an alert level of three. This weighting system may give rates of change that exceed the respective allowable rates of change by a large margin greater weight than those that only slightly exceed the respective allowable rate of change.

Referring also to FIG. 6E, at step 40, the PLC 15 may sum the alert levels of the deviations with the alert levels of the rates of change and divide by the maximum alert level to obtain the stuck pipe risk using the formula shown therein. The maximum alert level may simply be the maximum alert level for each deviation and rate of change (three as shown for each in FIGS. 6B and 6D) times the number of deviations and rates of change (four shown in FIGS. 3A and 3B for slide drilling), such as equaling twelve for slide drilling.

Consolidation of the deviations and rates of change to one stuck pipe risk value may facilitate comprehension of the risk by the driller.

Figure 7:
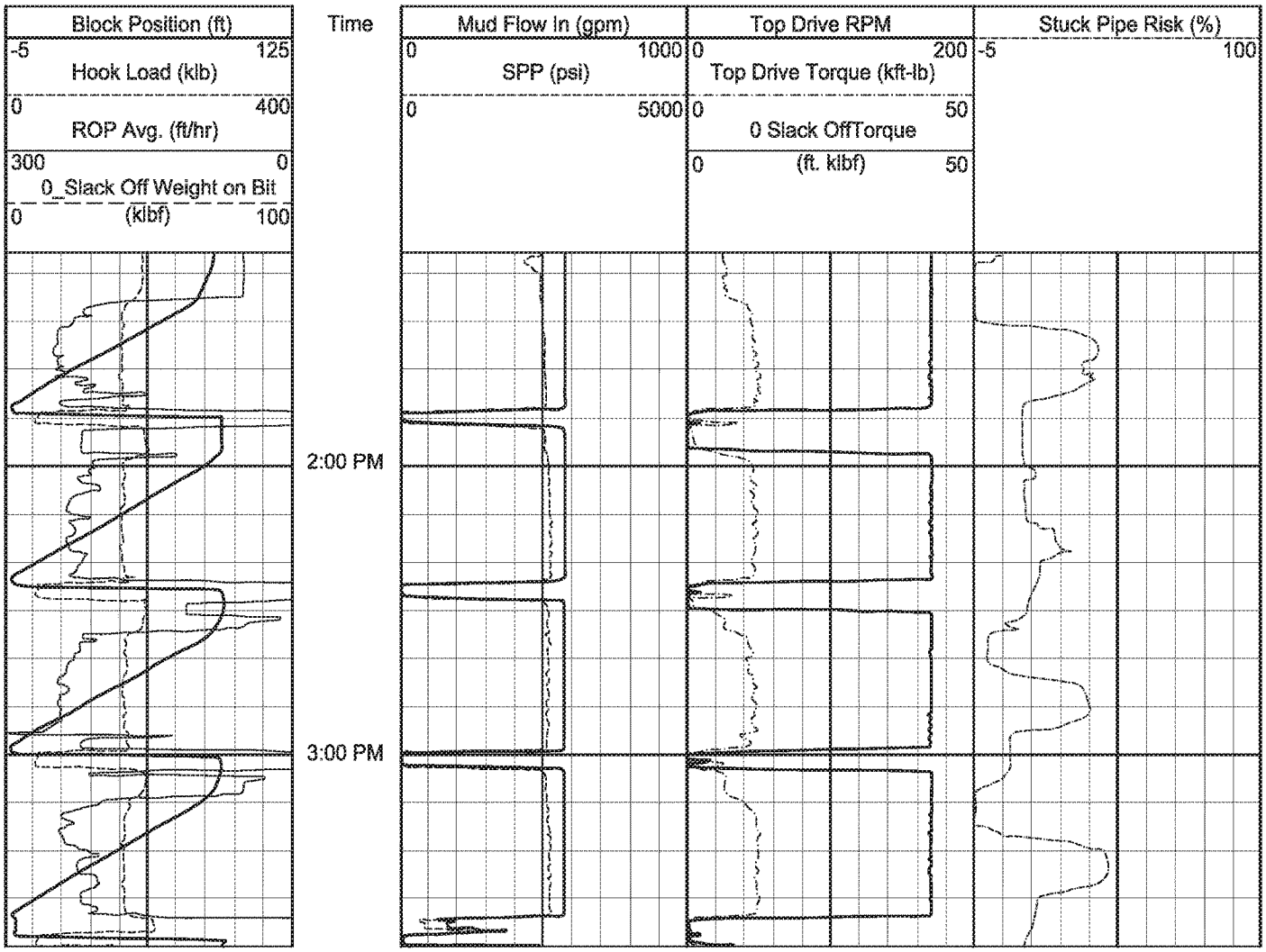
FIG. 7 illustrates display of the stuck pipe risk by the stuck pipe warning system.

At step 41, the PLC 15 may compare the stuck pipe risk to the risk threshold obtained from the historical analysis at step 30 and may alert the driller should the stuck pipe risk exceed the threshold. The alert may be audible and/or visible. The alert may include suggested remedial action, such as lowering bottom hole pressure, performing a clean-out operation, lessening weight on bit, and/or tripping the drill string 4 to reconfigure the BHA 4*b*. The PLC 15 may also display the stuck pipe risk as a plot on the driller's console (FIG. 7).

At step 42, the PLC 15 may store the results in a database for further analysis. The storage may be especially useful if a stuck pipe event does occur. The PLC 15 may then return to step 32 and continue iteration in real time until the activity has been completed. Once the activity has been completed, the PLC 15 may return to step 31 for a further activity, such as rotary drilling.

Figure 8:
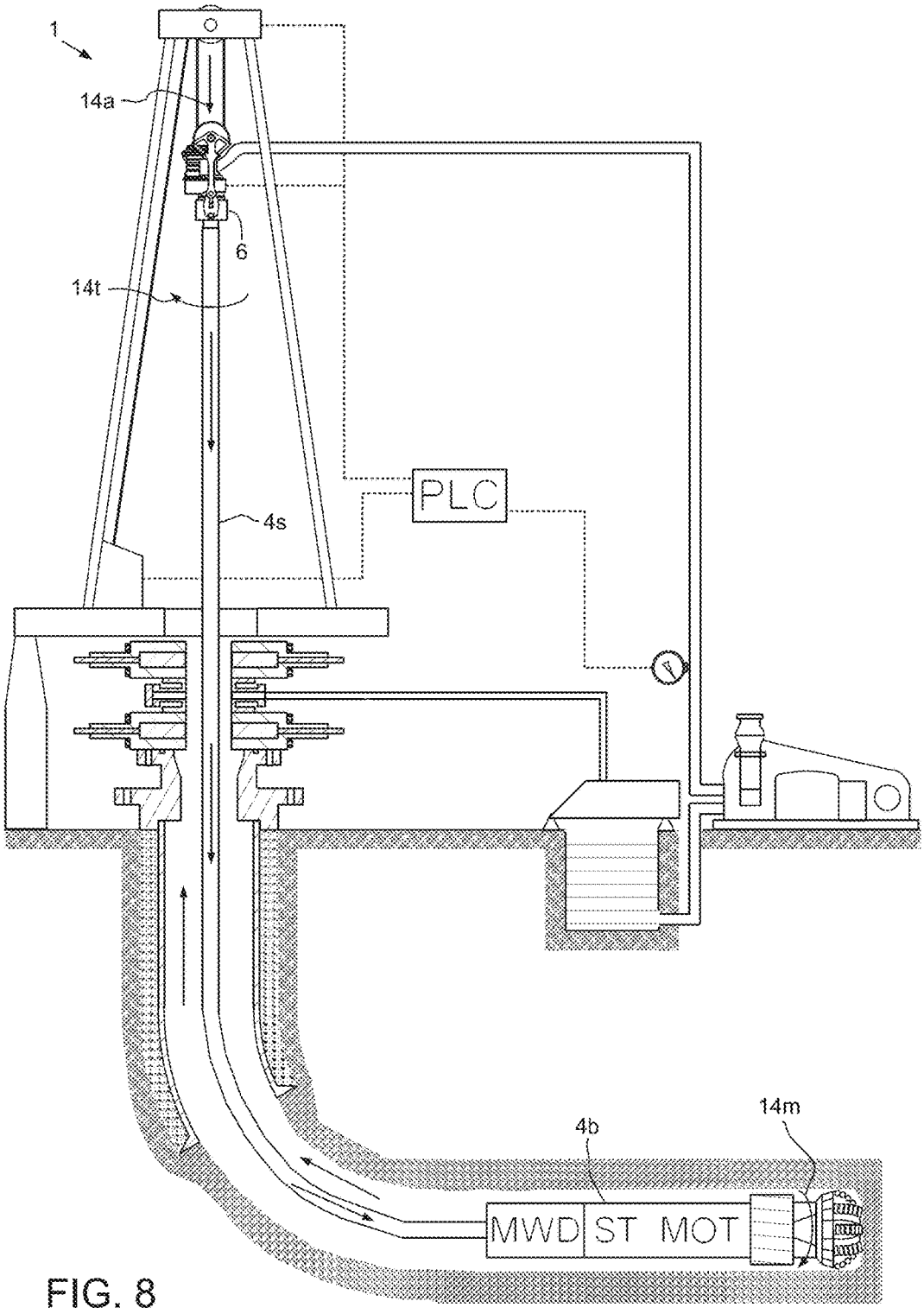
FIG. 8 illustrates rotary drilling of the wellbore using the drilling system.

FIG. 8 illustrates rotary drilling of the wellbore 2 using the drilling system 1. Once the BHA 4*b* has reached the desired trajectory, a mode of the drilling system 1 may be shifted from slide drilling to rotary drilling by operation of the top drive 6 to rotate 14*t* the pipe string 4*s*, thereby negating the curvature effect of the motor 10 and straightening the drilling trajectory (aka corkscrew path). The PLC 15 may detect the shift to rotary drilling and return to step 31 for monitoring the stuck pipe risk during the rotary drilling of the wellbore 2.

Figure 9:
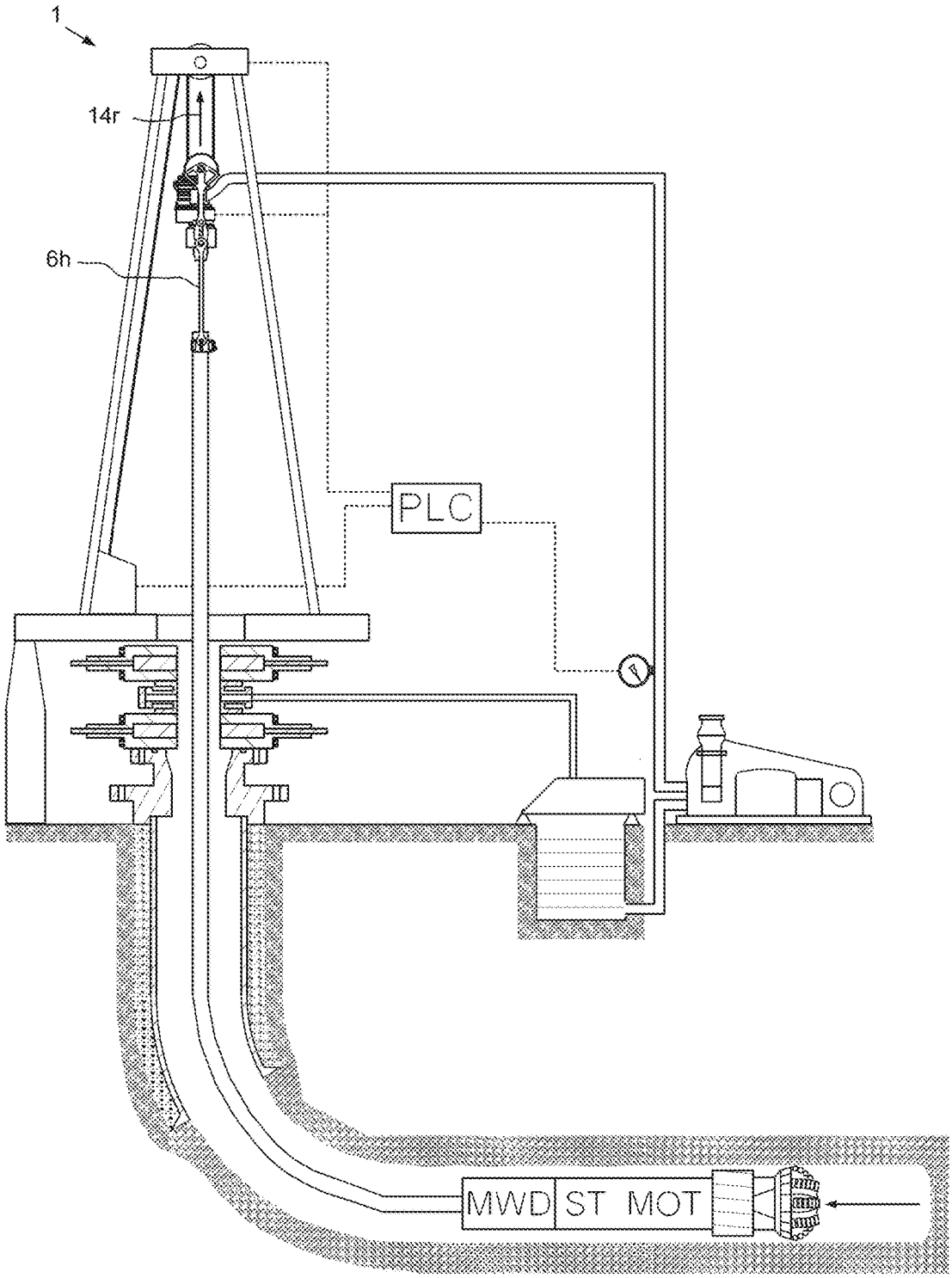
FIG. 9 illustrates tripping a drill string of the drilling system from the wellbore.

FIG. 9 illustrates tripping the drill string 4 from the wellbore 2. Once the wellbore 2 has been drilled to total depth, drilling may be halted by stopping rotation 14*t* of the pipe string 4*s* by the top drive 6, stopping lowering 14*a* of the traveling block 7*t*, stopping injection of the drilling fluid 25*d*, and removing weight from the drill bit 8. The drill string 4 may be supported from the rig floor 5*f*. The quill may be disconnected from the pipe string 4*s* and a pipe handler 6*h* of the top drive 6 operated in conjunction with tongs (not shown) and the traveling block 7*t* to disassemble and retrieve 14*r* the drill string 4 from the wellbore 2. The PLC 15 may detect the drilling stoppage and operation of the pipe handler 6*h* and return to step 31 for monitoring the stuck pipe risk during retrieval 14*r* of the drill string 4 from the wellbore (aka tripping out).

Figure 10:
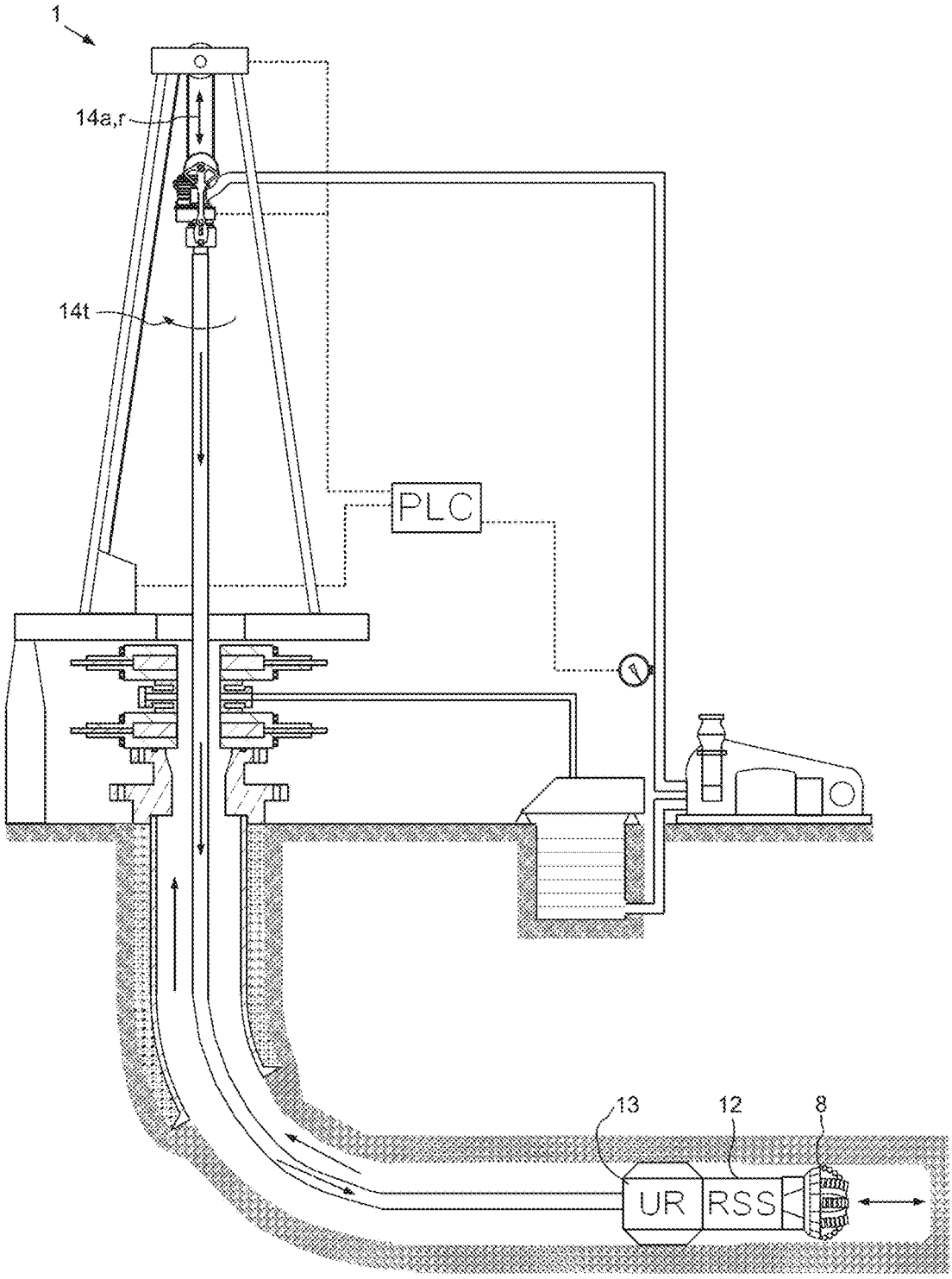
FIG. 10 illustrates reaming of the wellbore using the drilling system.

FIG. 10 illustrates reaming of the wellbore using the drilling system. Once the (drilling) BHA 4*b* has been retrieved to the rig floor 5*f*, the BHA 4*b* may be disassembled and replaced by a reaming BHA. The reaming BHA may include the drill bit 8, a rotary steerable system (RSS) 12, and an underreamer 13. The reaming BHA members 8, 12, 13 may be interconnected, such as by threaded couplings. A downlink (not shown) may be added to the fluid handling system if for communication with a controller of the RSS 12.

The pipe string 4*s* may be connected to the reaming BHA and further assembly thereof used to deploy 14*a* the reaming BHA into the wellbore 2 (aka tripping in). The PLC 15 may detect operation of the pipe handler 6*h* and return to step 31 for monitoring the stuck pipe risk during deployment of the reaming BHA into the wellbore.

The RSS 12 may include a mandrel having threaded couplings formed at each longitudinal end thereof and a housing having an actuator and a plurality of levers spaced therearound, such as three spaced at one hundred twenty degree intervals. The housing may be supported from the mandrel by bearings such that the housing may remain rotationally stationary relative to the mandrel. The actuator may include a hydraulic pump driven by relative rotation between the housing and the mandrel and a piston connected to each lever, a cylinder keeping each piston, and a manifold selectively providing fluid communication between each piston and the pump for extension or retraction of the respective lever. The RSS controller may receive steering instructions from the PLC 15 and operate one or more of the levers to point the bit 8 along the instructed path.

Alternatively, the RSS 17 may be a push type. Alternatively, the RSS 17 may be used to slide drill and rotary drill the wellbore 2 instead of the steering motor 10.

The reaming BHA may be lowered 14*a* into the lower formation 18*b* until a heel of the wellbore 2 is reached. The quill may then be connected to the upper end of the pipe string 4*s*, drilling fluid 25*d* injected through the pipe string and the reaming BHA and the top drive 6 operated to rotate the pipe string 4*s*. Arms of the underreamer may extend in response to injection of the drilling fluid through the reaming BHA and lowering 14*a* of the pipe string 4*s* may resume, thereby forward reaming the wellbore 2 (aka reaming in). The PLC 15 may detect the shift to forward reaming and return to step 31 for monitoring the stuck pipe risk during the reaming in of the wellbore 2.

Once the drill bit 8 reaches a toe of the wellbore 2, movement of the reaming BHA may be reversed to pull the reaming BHA along the wellbore, thereby backward reaming the wellbore (aka back reaming). The PLC 15 may detect the shift to backward reaming and return to step 31 for monitoring the stuck pipe risk during the back reaming of the wellbore 2.

Once the wellbore 2 has been back reamed to the heel thereof, the reaming may be halted by stopping rotation 14*t* of the pipe string 4*s* by the top drive 6, stopping raising 14*r* of the traveling block 7*t*, and stopping injection of the drilling fluid 25*d*. The pipe string 4*s* may be supported from the rig floor 5*f*. The quill may be disconnected from the pipe string 4*s* and the pipe handler 6*h* operated in conjunction with tongs (not shown) and the traveling block 7*t* to disassemble and retrieve 14*r* the pipe string 4*s* and reaming BHA from the wellbore 2. The PLC 15 may detect the reaming stoppage and operation of the pipe handler 6*h* and return to step 31 for monitoring the stuck pipe risk during retrieval 14*r* of the pipe string 4*s* and reaming BHA from the wellbore 2.

Alternatively, the wellbore 2 may only be forward reamed or reversed reamed but not both.

Figure 11:
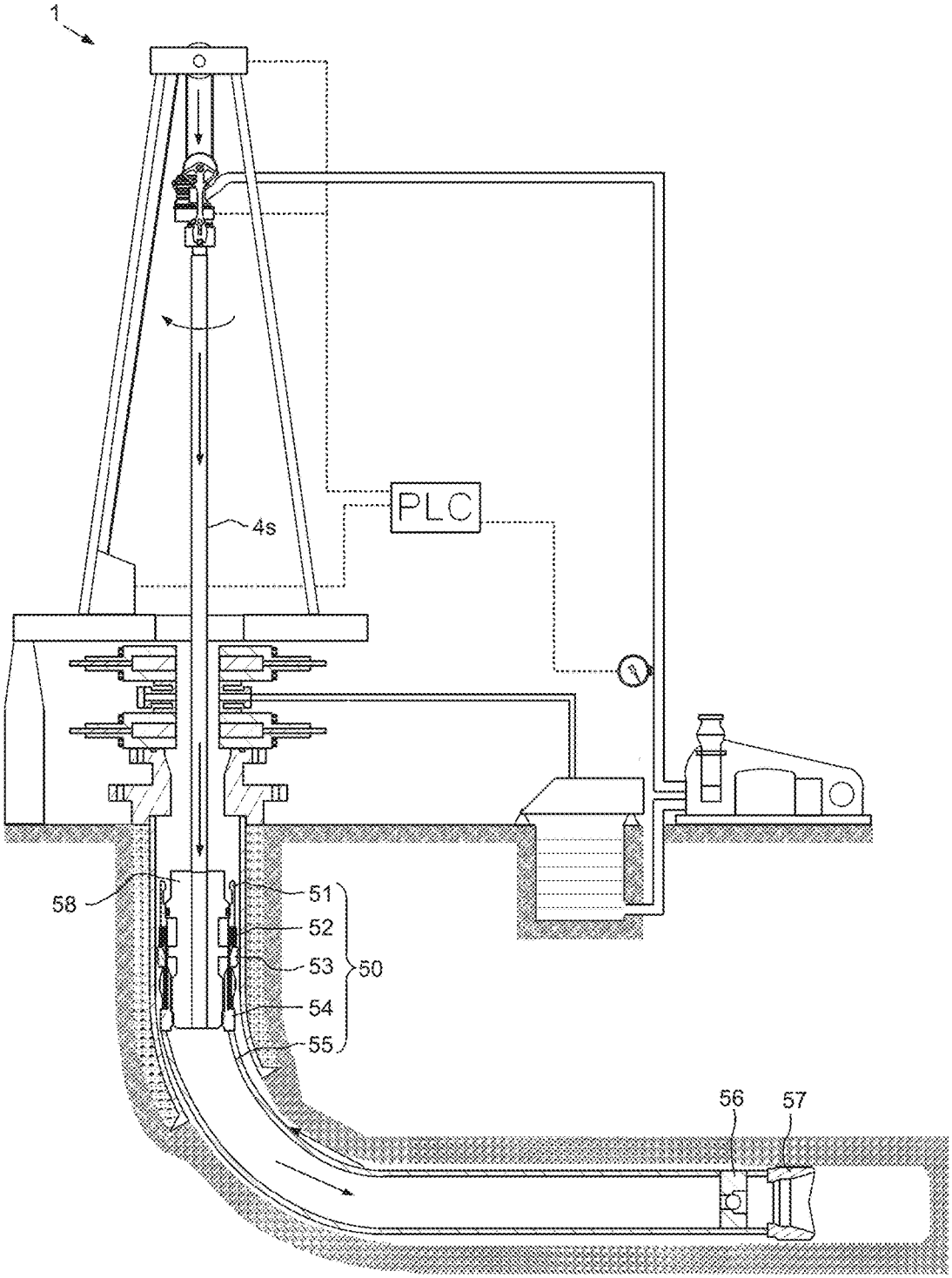
FIG. 11 illustrates reaming a liner string into the wellbore using the drilling system.

FIG. 11 illustrates reaming a liner string 50 into the wellbore 2 using the drilling system 1. Once the wellbore 2 has been reamed, the liner string 50 may be assembled using the drilling rig 1*r* and a work string used to deploy the liner string into the wellbore 2. The liner string 50 may include a polished bore receptacle (PBR) 51, a packer 52, a hanger 53, a mandrel 54 for carrying the hanger and packer, joints of liner 55, a float collar 56, and a reamer shoe 57. The mandrel 54, liner joints 55, float collar 56, and reamer shoe 57 may be interconnected, such as by threaded couplings. The work string may include the pipe string 4*s* and a liner deployment assembly (LDA) 58. An upper end of the LDA 58 may be connected to a lower end the pipe string 4*s*, such as by threaded couplings. The LDA 58 may also be releasably connected to the mandrel 54.

The liner string 50 may be lowered 14*a* into the wellbore 2 until the reamer shoe 57 reaches the lower formation 18*b*. The quill may then be connected to the upper end of the pipe string 4*s*, drilling fluid 25*d* injected through the work string and the liner string 50 and the top drive 6 operated to rotate

14*t* the work string and the liner string. Lowering 14*a* of the liner string 50 may resume, thereby reaming the liner string into the wellbore 2. The PLC 15 may detect the shift to liner reaming and return to step 31 for monitoring the stuck pipe risk during the reaming of the liner string 50 into the wellbore 2. The PLC 15 may utilize the allowable deviations and rates of change for reaming by the reaming BHA for reaming of the liner string.

Alternatively, separate allowable deviations and rates of change may be determined for the liner reaming during the analysis of the historical data.

Once the reamer shoe 57 reaches a depth in the wellbore 2 adjacent to the toe, a setting plug (not shown), such as a ball, may be launched and pumped down the pipe string 4*s* to the LDA 58. The setting plug may land in a seat of the LDA 58 and continued pumping may increase pressure in the pipe string 4*s* and an upper bore of the LDA 58 until the liner hanger 53 is set and the LDA is released from the liner string 50. The setting plug may then be released from the seat and stowed in a catcher of the LDA 58. A cement pump (not shown) may be operated to pump cement slurry (not shown) from a mixer (not shown) and into the pipe string 4*s* via a cement head (not shown). Once a desired quantity of cement slurry has been injected into the pipe string 4*s*, the cement head may be operated to launch a cementing plug, such as a dart (not shown).

The mud pump 19 may then be operated to pump chaser fluid (not shown) into the pipe string 4*s*, thereby driving the dart and cement slurry through the pipe string and into a bore of the liner string 50 until the dart seats in a wiper plug (not shown) of the LDA 58. Continued pumping of the chaser fluid may increase pressure to release the wiper plug from the LDA 58 and drive the cement slurry, wiper plug, and dart, down the liner string bore. The cement slurry may be driven through the float collar 56 and reamer shoe 57 and into the annulus until the wiper plug bumps the float collar. Pumping of the chaser fluid may then cease and the float collar 56 may close to prevent back flow of the cement slurry into the liner string bore. The LDA 58 may then be operated to set the packer 52 by articulation of the pipe string 4*s*. The work string may then be retrieved to the rig 1*r* and the drilling system 1 dispatched from the well site.

Alternatively, the stuck pipe warning system 3 may be used to run a casing or liner string into the wellbore 2 instead of reaming the liner string 50. Alternatively, the stuck pipe warning system 3 may be used to drill a casing or liner string into the lower formation 18 instead of slide and rotary drilling the lower formation. Alternatively, the stuck pipe warning system 3 may be used in a workover or intervention operation in the wellbore 2.

Figure 12:
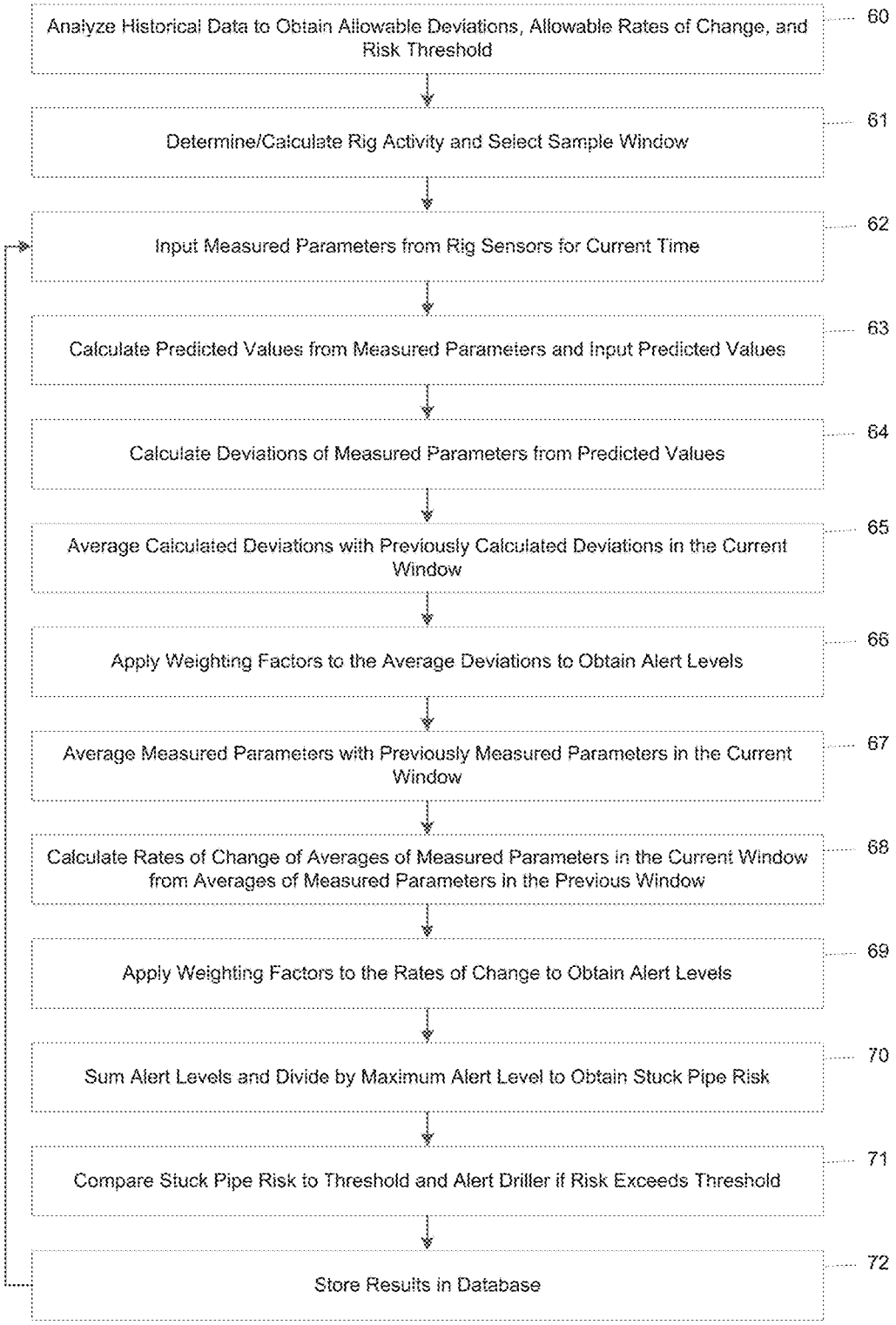
FIG. 12 illustrates an alternative method of operation of the stuck pipe warning system.

FIG. 12 illustrates an alternative embodiment of the stuck pipe warning system. In this embodiment, the predicted values may be calculated from the measured parameters using commercially available engineering software, such as Weatherford's OneSync Monitoring™. A continuous time-based prediction for the predicted values may be generated from real-time measured values for each parameter, such as torque, standpipe pressure, and hook load while accounting for changes in flow rate, weight on bit, revolutions per minute, and rig activity.

At step 60, the stuck pipe warning system may be manually initialized from the historical analysis in the same manner as step 30, discussed above. From the historical analysis, allowable deviations of the measured parameters from the expected values may be determined. The historical data may also be analyzed to determine allowable rates of change of the parameters with respect to time using the relationship between the bit velocity, depth, and time, where bit velocity multiplied by time equals a depth. The allowable deviations and rates of change may be determined for specific rig activities, such as rotary drilling, slide drilling, forward reaming (aka ream in), backward reaming, tripping of the drill string 4 into the wellbore 2, and tripping the drill string 4 from the wellbore 2. Only some of the parameters may be applicable for certain rig activities.

The allowable deviations and rates of change may be selected in the same manner as discussed above, with respect to step 30. Alternatively, the allowable rates of change of the parameters may be modified to accommodate for changes in an input parameter such as rotation speed, flow rate, or revolutions per minute. The allowable rates of change may be modified by multiplying by an average value of a selected input parameter over a short period of time (e.g. fifteen seconds) and dividing by an average value of the same input parameter over a longer period of time (e.g. one minute).

The stuck pipe risk threshold may be assessed in the same manner as discussed above, with respect to step 30.

Once the allowable deviations and rates of change have been determined from the analysis of the historical data, the allowable values may be provided to the PLC 15 for execution of the operating steps 61-72.

At step 61, the PLC 15 may determine the rig activity that is about to be performed, in the same manner as step 31.

Alternatively, the PLC 15 may prompt the driller to select the activity that is about to be performed.

At step 62, the PLC may input the measured parameters from the rig sensors, such as torque from the sensor of the top drive 6, standpipe pressure from the pressure sensor 22, and hook load from the detector (depicted by dashed line to crown block 7*c*) into the OneSync Monitoring™ software. At step 63, the OneSync Monitoring™ software may calculate predicted values from the respective measured parameters. The PLC 15 may input the predicted values from the OneSync Monitoring™ software.

Steps 64-72 may be carried out in the same manner as steps 34-42 discussed above. The PLC 15 may then return to step 62 and continue iteration in real time until the activity has been completed. Once the activity has been completed, the PLC 15 may return to step 61 for a further activity, such as rotary drilling.

The stuck pipe warning system of FIG. 12 may be operated during wellbore operations such as rotary drilling, slide drilling, forward reaming (aka ream in), backward reaming, tripping of the drill string 4 into the wellbore 2, and tripping the drill string 4 from the wellbore 2, in the same manner discussed above with respect to the stuck pipe warning system of FIG. 2, as shown in FIGS. 1 and 8-11.

While the foregoing is directed to embodiments of the present disclosure, other and further embodiments of the disclosure may be devised without departing from the basic scope thereof, and the scope of the invention is determined by the claims that follow.

The invention claimed is:

1. A method of performing a downhole operation in a wellbore, comprising:

performing the downhole operation in the wellbore from a rig based on a stuck pipe risk, wherein the downhole operation includes at least one of:

drilling the wellbore;

tripping a drill string from or into the wellbore;

reaming in or back reaming the wellbore; and running a casing or liner string into the wellbore; and while performing the downhole operation, repeatedly:

inputting one or more predicted values from a model of the wellbore;

inputting one or more measured parameters from one or more sensors of the rig;

calculating a deviation of each input measured parameter from a respective predicted value;

applying a first weighting factor to each calculated deviation to obtain a respective first alert level;

calculating a rate of change of each input measured parameter from a parameter previously measured by the respective sensor;

applying a second weighting factor to each calculated rate of change to obtain a respective second alert level; and adding the first and second alert levels and dividing a sum thereof by a maximum alert level to obtain the stuck pipe risk.

2. The method of claim 1, wherein:

the method further comprises analyzing historical data from previously drilled wellbores to obtain one or more allowable deviations and one or more allowable rates of change, and the weighting factors are applied using the respective allowable deviations and allowable rates of change.

3. The method of claim 2, wherein:

each of the allowable deviations range between an absolute value of 2-25%, and each of the allowable rates of change range between an absolute value of 2-25%.

4. The method of claim 2, wherein:

the measured parameters and the previously measured parameters comprise hook load and standpipe pressure, each of the allowable deviations and allowable rates of change for hook load are negative, and each of the allowable deviations and allowable rates of change for standpipe pressure are positive.

5. The method of claim 2, wherein:

the historical data is further analyzed to obtain a risk threshold, and the method further comprises:

comparing the stuck pipe risk to the risk threshold; and alerting a driller if the stuck pipe risk exceeds the risk threshold.

6. The method of claim 1, wherein:

the method further comprises averaging each calculated deviation with respective previously calculated deviations in a current sample window;

each first weighting factor is applied to the respective average calculated deviation.

7. The method of claim 6, wherein:

each previously measured parameter is an average of respective previously measured parameters in a previous sample window, the method further comprises averaging each measured parameter with respective previously measured parameters in the current sample window, and each rate of change is calculated using the respective averages of the respective measured parameters in the sample windows.

8. The method of claim 1, further comprising displaying a plot of the stuck pipe risk on a driller's console.

9. The method of claim 1, further comprising interpolating the predicted values to a current depth of the downhole operation.

10. The method of claim 1, wherein:

the rig is a drilling rig, and the downhole operation is drilling the wellbore.

11. The method of claim 10, wherein:

the downhole operation is slide drilling, and the measured parameters comprise hook load and standpipe pressure.

12. The method of claim 10, wherein:

the downhole operation is rotary drilling, and the measured parameters comprise hook load, torque, and standpipe pressure.

13. The method of claim 1, wherein:

the rig is a drilling rig, the downhole operation is tripping a drill string from or into the wellbore, and the measured parameters comprise hook load.

14. The method of claim 1, wherein:

the rig is a drilling rig, and the downhole operation is reaming in or back reaming the wellbore, and the measured parameters comprise hook load, torque, and standpipe pressure.

15. The method of claim 1, wherein:

the rig is a drilling rig, and the downhole operation is running a casing or liner string into the wellbore.

16. The method of claim 1, further comprising calculating the one or more predicted values for the model from the one or more measured parameters.

17. The method of claim 2, further comprising modifying the one or more rates of change to account for changes in rotation speed, flow rate, or revolutions per minute during the downhole operation.

18. The method of claim 1, wherein the operation further comprises performing a remedial action based on the stuck pipe risk.

19. The method of claim 2, further comprising:

a deviation ratio is calculated to apply the first weighting factor to each calculated deviation to obtain the respective first alert level;

a rate of change ratio is calculated to apply the second weighting factor to each calculated rate of change to obtain the respective second alert level; and each respective first alert level is assigned a first alert level value, wherein:

the first alert level value is 0 if the deviation ratio is less than 1;

the first alert level value is equal to the deviation ratio if the deviation ratio is greater than or equal to 1 and less than or equal to 3; and the first alert level is 3 if the deviation ratio is greater than 3;

each respective second alert level is assigned a second alert level value, wherein:

the second alert level value is 0 if the rate of change ratio is less than 1;

the second alert level value is equal to the rate of change ratio if the rate of change ratio is greater than or equal to 1 and less than or equal to 3;

the second alert level is 3 if the rate of change ratio is greater than 3.

20. A method of performing an operation in a wellbore from a rig, comprising:

performing the operation in the wellbore from the rig based on a stuck pipe risk, wherein the operation includes at least one of:

drilling the wellbore;

tripping a drill string from or into the wellbore;

reaming in or back reaming the wellbore; and running a casing or liner string into the wellbore; and while performing the operation, repeatedly:

measuring one or more parameters using one or more sensors of the rig;

obtaining one or more predicted values from a model of the wellbore;

calculating a deviation of each measured parameter from a respective predicted value;

applying a first weighting factor to each calculated deviation to obtain a respective first alert level;

calculating a rate of change of each measured parameter from a parameter previously measured by the respective sensor;

applying a second weighting factor to each calculated rate of change to obtain a respective second alert level; and adding the first and second alert levels and dividing a sum thereof by a maximum alert level to obtain the stuck pipe risk.

21. A drilling system, comprising:

a rig operable to perform an operation in a wellbore, the rig including one or more sensors operable to monitor at least one measured parameter selected from the group of: standpipe pressure, hook load, and torque of a top drive; and a programmable logic controller (PLC) in communication with the one or more sensors, wherein the PLC is configured to control the operation based on a stuck pipe risk by:

inputting one or more predicted values from a model of the wellbore;

inputting one or more of the measured parameters from the one or more sensors of the rig;

calculating a deviation of each input measured parameter from a respective predicted value;

applying a first weighting factor to each calculated deviation to obtain a respective first alert level;

calculating a rate of change of each input measured parameter from a parameter previously measured by the respective sensor;

applying a second weighting factor to each calculated rate of change to obtain a respective second alert level; and adding the first and second alert levels and dividing a sum thereof by a maximum alert level to obtain the stuck pipe risk.

* * * * *